US007806270B2

(12) United States Patent
Seibert et al.

(10) Patent No.: US 7,806,270 B2
(45) Date of Patent: Oct. 5, 2010

(54) CHILD-RESISTANT, SENIOR-FRIENDLY UNIT DOSE CONTAINER

(75) Inventors: Ronald J. Seibert, Machesney Park, IL (US); Ryen Sack, Loves Park, IL (US); Curt Knutson, Loves Park, IL (US); Shawn P. Reilley, Belvidere, IL (US)

(73) Assignee: Anderson Packaging, Inc., Rockford, IL (US)

( * ) Notice: Subject to any disclaimer, the term of this patent is extended or adjusted under 35 U.S.C. 154(b) by 455 days.

(21) Appl. No.: 11/839,982

(22) Filed: Aug. 16, 2007

(65) Prior Publication Data

US 2009/0045096 A1 Feb. 19, 2009

(51) Int. Cl.
*B65D 83/04* (2006.01)
*B65B 1/04* (2006.01)

(52) U.S. Cl. ..... 206/531; 206/538; 206/528; 53/467

(58) Field of Classification Search ..... 206/528, 206/530, 531, 532, 533, 535, 536, 537, 538, 206/539, 1.5; 220/553, 554, 555; 53/467
See application file for complete search history.

(56) References Cited

U.S. PATENT DOCUMENTS

| | | | | |
|---|---|---|---|---|
| 1,984,351 A | | 12/1934 | Johnson | |
| 2,790,587 A | | 4/1957 | Contant | |
| 3,072,276 A | | 1/1963 | Nichols | |
| 3,429,426 A | | 2/1969 | Wolf et al. | |
| 3,504,788 A | | 4/1970 | Gray | |
| D217,900 S | | 6/1970 | Gray | |
| 3,811,564 A | | 5/1974 | Braber | |
| 3,888,350 A | | 6/1975 | Horvath | |
| 3,942,630 A | * | 3/1976 | Phillips | 206/1.5 |
| 4,048,050 A | * | 9/1977 | Hillman | 206/1.5 |
| 4,120,400 A | | 10/1978 | Kotyuk | |

(Continued)

FOREIGN PATENT DOCUMENTS

DE 10355803 A1 6/2005

(Continued)

OTHER PUBLICATIONS esp@cenet database, one page English language Abstract for DE 10355803, Jun. 30, 2005.

(Continued)

*Primary Examiner*—J. Gregory Pickett
(74) *Attorney, Agent, or Firm*—Howson & Howson LLP

(57) ABSTRACT

A child-resistant and senior-friendly unit dose package has a hollow container body, an internal divider, and at least first and second separate trays each carrying a plurality of tablets or like items for being dispensed from the container body. The container body has an end with an opening, and each tray can be slid to a retracted position in which the tray is located within the container body and a dispensing position in which the tray extends at least partially through the opening of the container body. The package includes a separate cap removably securable to the container body to seal the opening and prevent access to the trays. Multiple simultaneous manipulations are required to remove the cap from the container body thereby providing a child-resistant connection. A method of assembling a package with at least two separate blister cards and a divider is also disclosed.

16 Claims, 5 Drawing Sheets

U.S. PATENT DOCUMENTS 4,125,190 A 11/1978 Davie, Jr. et al.
4,126,224 A 11/1978 Laauwe et al.
4,192,422 A 3/1980 Kotyuk
4,375,858 A 3/1983 Shah et al.
4,511,032 A 4/1985 Bush
4,817,819 A 4/1989 Kelly
4,889,238 A 12/1989 Batchelor
5,050,739 A 9/1991 Hannan et al.
5,082,137 A 1/1992 Weinstein
5,125,505 A 6/1992 Kurosaki
5,251,757 A * 10/1993 Relyea et al. ..... 206/531
5,265,728 A 11/1993 Allendorf et al.
5,275,291 A 1/1994 Sledge
5,339,960 A 8/1994 Price
5,346,069 A 9/1994 Intini
5,379,899 A 1/1995 Thurell
5,740,938 A 4/1998 Hofmann et al.
5,755,020 A 5/1998 Panyon et al.
5,758,774 A 6/1998 Leblong
5,878,887 A 3/1999 Parker et al.
5,915,559 A 6/1999 Hulick et al.
6,021,901 A 2/2000 Wolfe
6,036,018 A 3/2000 Harrold
6,161,699 A 12/2000 Gartland
6,230,893 B1 5/2001 Karow
6,247,595 B1 6/2001 Omata et al.
6,349,831 B1 2/2002 Buss
6,401,926 B1 6/2002 Lo
6,460,693 B1 10/2002 Harrold
6,540,081 B2 4/2003 Balz et al.
6,564,945 B1 * 5/2003 Weinstein et al. ..... 206/531
6,679,381 B1 1/2004 Bush
6,708,826 B1 3/2004 Ginsberg et al.
6,789,677 B2 9/2004 Maietta
6,832,686 B2 12/2004 Donegan
6,863,175 B2 3/2005 Gelardi
6,874,636 B2 4/2005 Paliotta et al.
6,896,137 B2 5/2005 McHutchinson
6,913,149 B2 7/2005 Gelardi et al.
7,093,736 B2 8/2006 Maietta et al.
7,175,044 B2 2/2007 Benktzon et al.
7,347,325 B2 3/2008 O'Neill et al.
7,370,773 B2 5/2008 Toth et al.
7,581,642 B2 9/2009 Knutson et al.
7,617,935 B2 11/2009 Reilley et al.
2003/0080021 A1 5/2003 Kopecky
2003/0136698 A1 7/2003 Klatt
2004/0045858 A1 3/2004 Harrold
2004/0256277 A1 12/2004 Gedanke
2005/0115862 A1 6/2005 Maietta
2005/0183981 A1 8/2005 Gelardi
2005/0199527 A1 9/2005 Ellis et al.
2006/0006091 A1 1/2006 Maietta
2007/0023317 A1 2/2007 Brozell et al.
2007/0039851 A1 2/2007 Rasanen et al.
2007/0045150 A1 3/2007 Huffer et al.
2007/0102318 A1 5/2007 Gelardi et al.
2007/0138049 A1 6/2007 Bitner
2007/0235368 A1 10/2007 Knutson et al.
2008/0251410 A1 10/2008 Gelardi
2008/0290109 A1 11/2008 Williams
2009/0045078 A1 2/2009 Gelardi et al.

FOREIGN PATENT DOCUMENTS

EP 1088769 A1 4/2001
GB 2319244 A 5/1998
WO 02/06135 A1 1/2002

OTHER PUBLICATIONS

R. Sack et al., unpublished (to date) co-pending U.S. Appl. No. 12/577,228, filed Oct. 12, 2009.

* cited by examiner

CHILD-RESISTANT, SENIOR-FRIENDLY UNIT DOSE CONTAINER

BACKGROUND OF THE INVENTION

The present invention relates to a container, or package, for containing items, such as doses of medicine, that can be dispensed therefrom, and more particularly, the present invention relates to a unit dose package that includes a blister or blister card and that has child-resistant, senior-friendly dispensing properties.

Paperboard unit dose packages for use in dispensing medicine tablets are disclosed by U.S. Pat. No. 6,047,829 issued to Johnstone et al., U.S. Pat. No. 6,874,636 B2 issued to Paliotta et al., and U.S. Pat. No. 6,230,893 B1 issued to Karow. Other containers for pills and the like are disclosed by U.S. Patent Application Publication Nos. 2005/0183981 A1 of Gelardi, 2005/0115862 A1 of Maietta, and 2005/0199527 A1 of Ellis et al., and by U.S. Pat. Nos. 4,192,422 and 4,120,400 issued to Kotyuk, U.S. Pat. No. 4,817,819 issued to Kelly, U.S. Pat. No. 6,349,831 B1 issued to Buss, U.S. Pat. No. 6,789,677 B2 issued to Maietta, U.S. Pat. No. 4,126,224 issued to Laauwe et al., U.S. Pat. No. 6,896,137 B2 issued to McHutchinson, U.S. Pat. No. 6,460,693 B1 issued to Harrold, U.S. Pat. No. 5,082,137 issued to Weinstein, U.S. Pat. No. 3,942,630 issued to Phillips, U.S. Pat. No. 5,878,887 issued to Parker et al., U.S. Pat. No. 6,401,926 B1 issued to Lo, U.S. Pat. Nos. 4,511,032 and 6,679,381 B1 issued to Bush, U.S. Pat. No. 6,021,901 issued to Wolfe, U.S. Pat. No. 6,832,686 B2 issued to Donegan, U.S. Pat. No. 5,346,069 issued to Intini, U.S. Pat. No. 6,913,149 B2 issued to Gelardi et al., U.S. Pat. No. 6,863,175 B2 issued to Gelardi, U.S. Pat. No. 6,540,081 B2 issued to Balz et al., U.S. Pat. No. 3,504,788 issued to Gray, U.S. Pat. No. 5,740,938 issued to Hofmann et al., and U.S. Pat. No. 4,048,050 issued to Hillman.

Although the above referenced unit dose packages and pill boxes disclosed by the above referenced patents and published applications may be satisfactory for their intended purposes, there is a need for a unit dose package of novel construction that is difficult for a child to open, yet readily opened and closed by an intended end-user, such as a senior citizen. Preferably, the container includes a blister, blister card, tray or the like on which numerous items, such as doses of medicine, are individually secured. The blister, blister card or tray should be able to be slid between a retracted position in which the items are protected and housed within the package and a dispensing position in which the blister, blister card or tray extends in an exposed condition from the package, but remains connected to the package.

BRIEF SUMMARY OF THE INVENTION

According to the present invention, a package for storing and dispensing tablets and like items is provided. The package includes a hollow plastic container body having an end with a mouth finish defining an opening and a divider positioned within the container body defining separate cavities on either side thereof within the container body. First and second separate trays each carrying a plurality of tablets or like items are positioned within opposite ones of the cavities on opposite sides of the divider. Each of the trays is slidable relative to the container body such that each tray is slidable between a retracted storage position in which the tray is located within the container body and a dispensing position in which at least a part of the tray extends through the opening of the container body. Preferably, the package includes a cap for sealing the container closed.

In a preferred embodiment, the container body and cap are made of plastic, and the cooperative engagement of lugs within channels enables the cap to be secured to the container body. A spring, such as a leaf spring, urges the lugs into a captured position within the slots. Thus, removal of the cap from the container body requires hand pressure exerted simultaneously in both downward and lateral directions on the cap. Further, preferably the trays are blister cards and the opening of the container body corresponds to the end profile of the blister card. A mechanism for preventing complete removal of the blister cards from the container body is also provided.

According to another aspect of the present invention, a method of assembling the above referenced package is provided. A one-piece plastic molded article is positioned in an open condition. The article includes opposed body sections interconnected at ends thereof. Thereafter, a first blister card is placed within one of the body sections, a second separate blister card is placed in the other body section, and a separate plastic divider is placed into one of the body sections over one of the first or second blister cards. Thereafter, the one-piece article is folded together into a closed condition to form a hollow container body which houses the first and section blister cards separated by the divider.

BRIEF DESCRIPTION OF THE DRAWINGS

The present invention should become apparent from the following description when taken in conjunction with the accompanying drawings, in which.

DETAILED DESCRIPTION OF THE INVENTION

Figure 1:
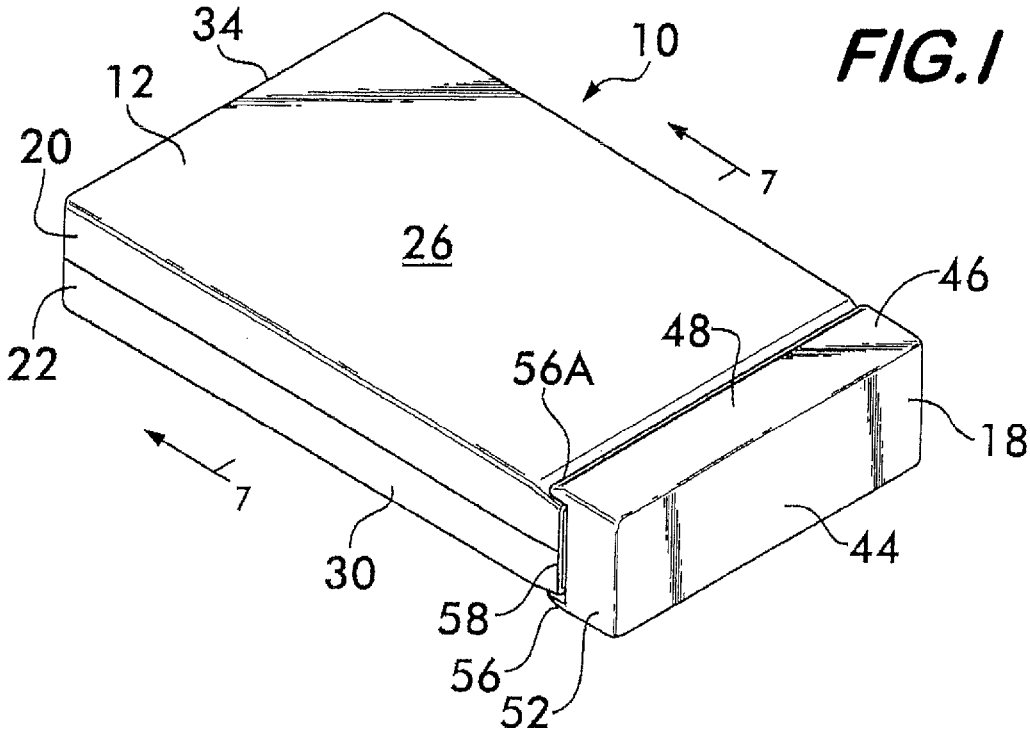
FIG. 1 is perspective view of an assembled container with a cap according to the present invention.
Figure 2:
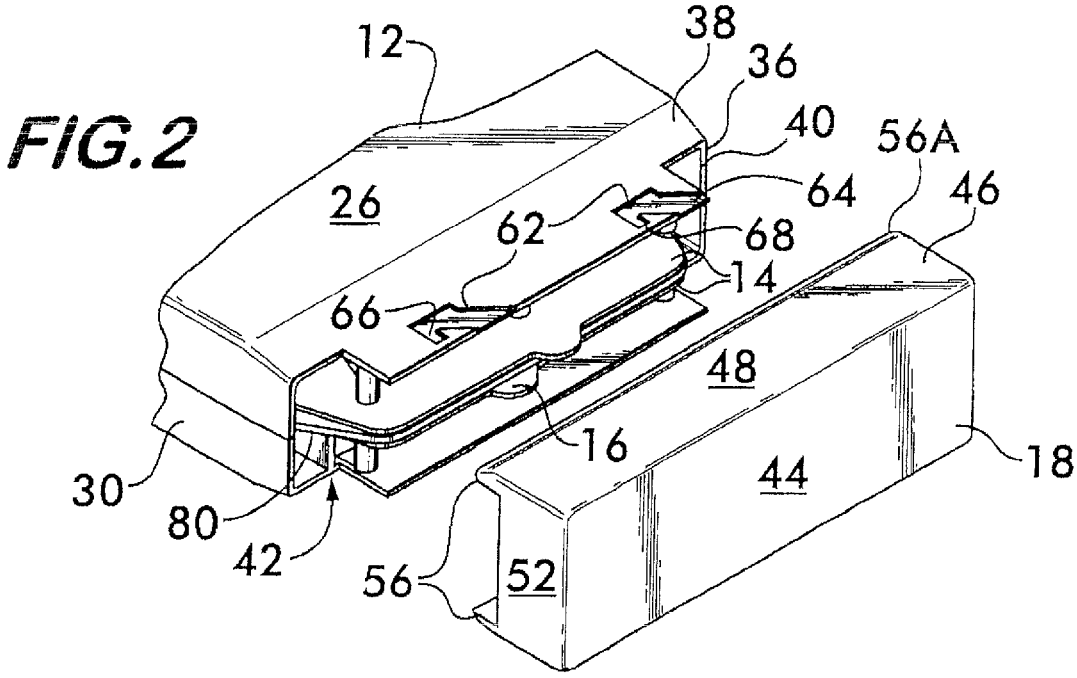
FIG. 2 is a perspective view of the mouth of the assembled container of FIG. 1 with the cap removed therefrom.
Figure 7:
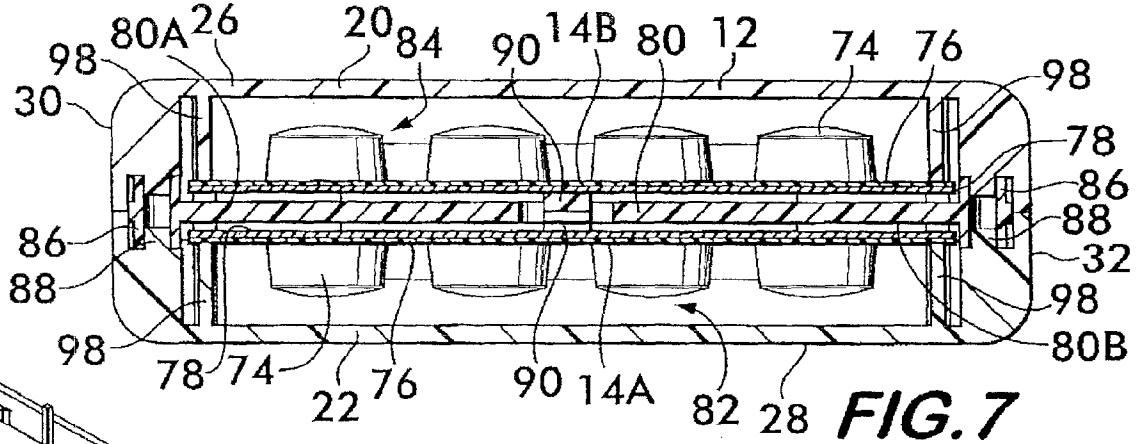
FIG. 7 is a cross-sectional view of the assembled container taken along lines 7-7 of FIG.1.

A package 10 according to the present invention is illustrated in FIGS. 1, 2 and 7. It includes a container body 12, a pair of separate trays or cards 14 to which a plurality of dispensable items are secured, and a cap 18. The assembled package 10 is similar in some ways to the packages disclosed in co-pending U.S. patent application Ser. No. 11/619,680 filed on Jan. 4, 2007, the disclosure of which is incorporated herein by reference.

The body 12 and cap 18 of the present invention are molded of a thermoplastic material and, when assembled, are shaped to house two or more separate trays or blister cards 14 or the like. The body 12 can have a generally compact configuration such as being substantially flat and rectangular as illustrated in FIG. 1. The body 12 and/or cap 18 can be made by injection-molding, blow-molding, thermoforming, or other molding techniques.

Figure 3:
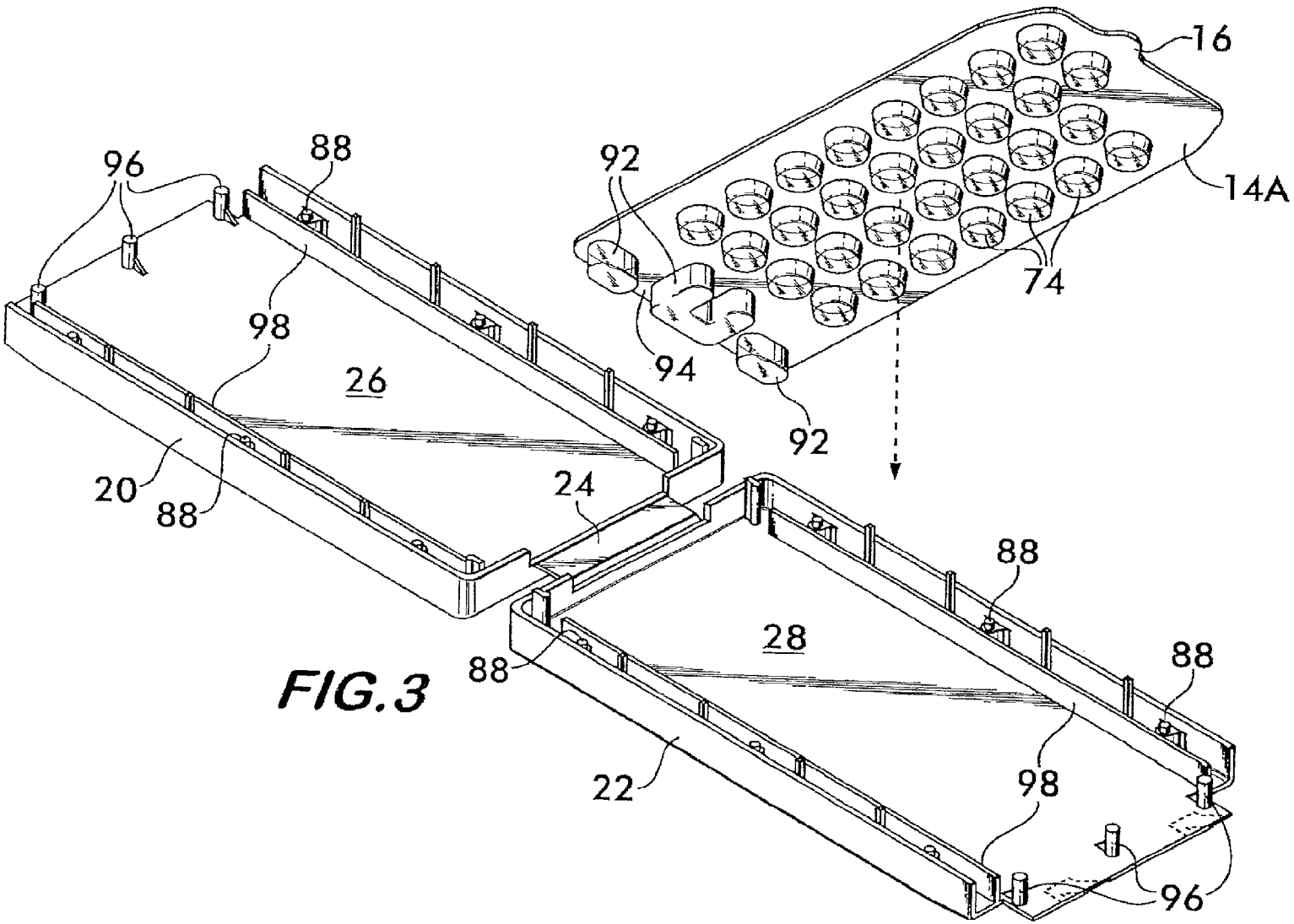
FIG. 3 is a perspective view showing the container of FIG. 1 during assembly in which a first blister card is ready for placement therein.

As best illustrated in FIG. 3, the body 12 can be formed by a pair of opposed body sections, 20 and 22, interconnected by a connecting wall 24 providing a so-called clam shell assembly. As an example, each of the body sections, 20 and 22, can form about half of the container body 12 and can be pivotable, or foldable, about the connecting wall 24. Thus, after the body sections, 20 and 22, are loaded with cards 14, they can be pivoted about the connecting wall 24 into a container-forming configuration as best illustrated in FIGS. 1, 2 and 7. Thereafter, the body sections, 20 and 22, can be secured together, for instance, via sonic welding techniques, adhesives, mechanical fasteners, or other bonding or fastening technique. As an alternative to the formation and use of a connecting wall 24, the body sections 20 and 22 can be formed separately, or can be separated after manufacture, and then the separate sections can be mated and secured together to form the container body 12.

When assembled, the plastic body 12 includes opposite front and rear walls 26 and 28, opposite sidewalls 30 and 32, a closed end 34, and an opposite open end 36. A mouth finish 38 of the container body 12 includes a rim 40 that defines a substantially rectangular, elongate opening 42 through which the trays, blister cards 14 or the like can be extended. See FIG. 2. The trays or blister cards 14 may contain doses of medicine, vitamins, supplements, or any other product that is provided in tablet form.

The separate cap 18 is securable to the body 12 to seal the open end 36 and is removable from the body 12 to permit the trays 14 to be freely slid through the open end 36 into a dispensing position. The cap 18 can be repeatedly attached to and removed from the container body 12 until all items have been dispensed from the tray 14. Preferably, the connection formed between the cap 18 and container body 12 is one that prevents unwanted dislodgement by young children, yet is readily removable by adults including seniors.

The cap 18 includes an end wall 44 that corresponds to and is designed to span and obstruct access to the elongate opening 42 of the container body 12. The cap 18 also includes a peripheral skirt 46. The skirt 46 includes opposed front and rear flaps, 48 and 50, and opposed side flaps, 52 and 54. As best illustrated in FIG. 2, the front and rear flaps, 48 and 50 extend a greater distance from the end wall 44 then do the sidewall flaps, 52 and 54, thereby forming ears or extensions 56. See FIG. 2.

When the cap 18 is secured to the container body 12, the ears or extensions 56 extend onto and overlap the front and rear walls, 26 and 28, of the container body 12, whereas the side flaps, 52 and 54, of the cap skirt 46 extend within the same plane as the corresponding sidewalls, 30 and 32, of the container body 12 with a small open gap 58 being formed therebetween. See FIG. 1. In addition, preferably the mouth finish 38 of the container body 12 adjacent the rim 40 is formed at a slight inward taper (see FIG. 2) to ensure tight engagement between the ears or extensions 56 and the front and rear walls, 26 and 28, of the container body 12. Further, preferably the end tips 56A of the ears or extensions 56 have a beveled edge as shown in FIG. 2.

All of the above described features with respect to the cap 18 and body 12 permit the package 10 to achieve desired levels of child-proofing. For example, the overlapping relation of the ears or extensions 56 on the front and rear walls 26 and 28 of the container body 12, the slight taper of the mouth finish 38 of the container body 12, and the beveled edge of the end tips 56A of the ears or extensions 56 provide a combined effect that makes it difficult for a young child to position a finger or tooth under the ears or extensions 56 of the cap 18 and pry the cap 18 from the container body 12 in an undesired manner. Of course, if child-proofing properties are not required, a package can be made without at least some of these features.

Preferably, the cap 18 of the present invention snaps onto the mouth finish 38 of the container body 12 and requires multiple simultaneously manipulations by the end-user to be removed from the container body 12. As an example, the container body 12 and cap 18 can be designed so that removal is accomplished only by the simultaneous actions of depressing the cap 18 relative to the container body 12 and sliding the cap 18 laterally relative to the container body 12 toward one of the sidewalls, 30 or 32, of the container body 12.

The mechanism for creating the cap-to-container body connection can be provided by a series of lugs 60 located on the inside of the cap skirt 46 and a series of slots, or channels, 62 formed in the mouth finish 38 of the container body 12. The slots 62 provide pathways along which the lugs 60 are permitted to travel when the cap 18 engages the container body 12. As an alternative, the lugs can extend from the mouth finish of the container body, and slots can be formed in the cap skirt.

As best illustrated in FIG. 2, a pair of slots 62 is provided on each side of the elongate opening 42 of the container body 12. Each slot 62 includes an open top 64 through which a corresponding lug 60 can enter and a reversely-turned section 66 in which the lug 60 can be captured thereby retaining the cap 18 to the container body 12. As illustrated, the slots 62 have a substantially "J" or "U" shaped configuration. The upper portion of each reversely-turned section 66 includes a perimeter wall or like obstruction 68 that prevents movement of the lug 60 in forward and lateral directions. A spring or like mechanism 70 is located within the cap 18 and exerts a force that biases the cap 18 away from the container body 12. Thus, when the lugs 60 are located within the reversely-turned sections 66 of the slots 62, the spring 70 exerts a force between the cap 18 and container body 12 that prevents the lugs 60 from escaping the reversely-turned sections 66. This locks the cap 18 to the container body 12 and prevents unwanted removal of the cap 18 without the manipulations discussed above.

Figure 8:
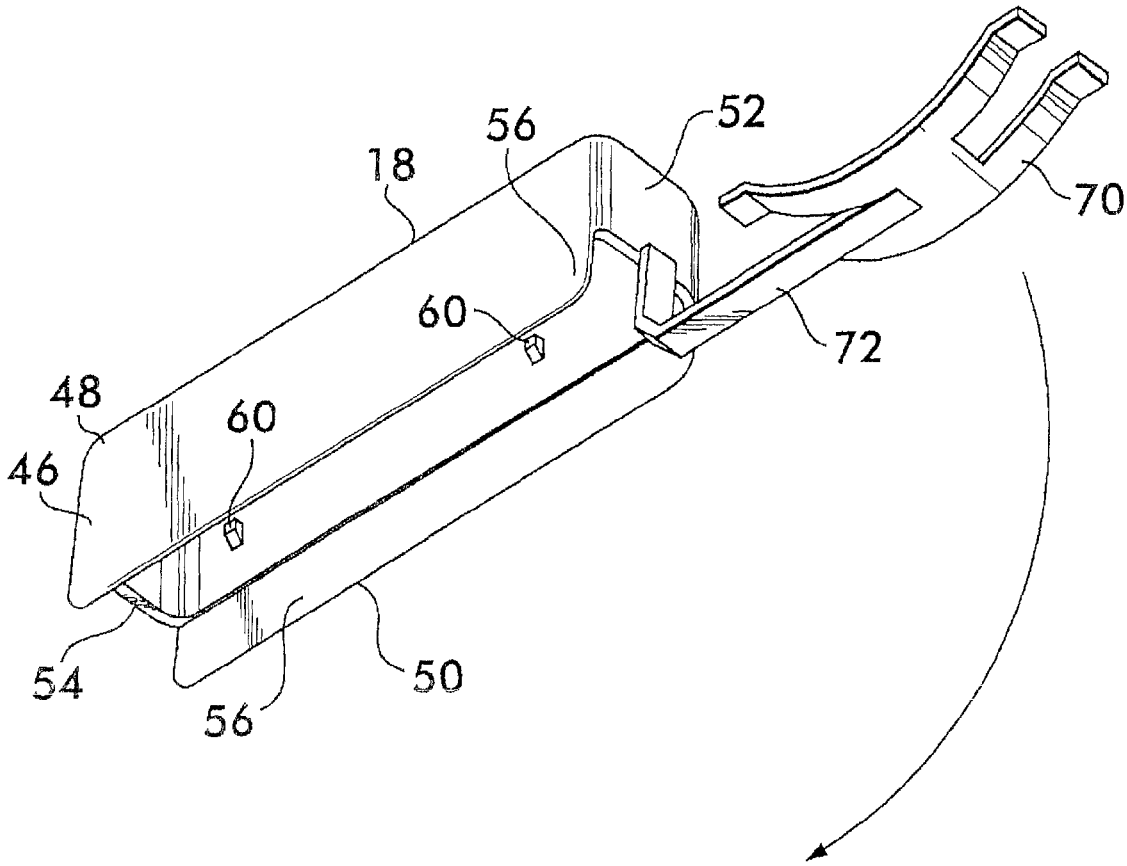
FIG. 8 is a perspective view of the cap of FIG. 1, as manufactured.

Preferably, the spring 70 is a leaf spring or the like and is mounted on the underside of the end wall 44 of the cap 18 so that, when the cap 18 is engaged to the container body 12, the spring 70 engages the rim 40 or other part of the container body 12. As an example, FIG. 8 illustrates a spring 70 having an H-shaped configuration which is curved, or bowed, along its length. The spring 70 is captured within the cap 18 by the lugs 60 and other abutments (not shown) formed on the underside of the end wall 44 of the cap 18. When the cap 18 is secured to the container body 12, the H-shaped spring 70 applies a force to lock the lugs 60 within corresponding slots 62. When pressure is exerted downwardly on the cap 18, the spring 70 flattens thereby permitting the lugs 60 to exit the slots 62. Upon removal of the cap 18 from the container body 12, the spring 70 automatically and resiliently returns to its original and memorized bowed configuration.

FIG. 8 illustrates a cap assembly, as manufactured. The cap 18 is simultaneously molded with the spring 70 in the same mold and of the same material. The cap 18 is connected to the spring 70 via an arm 72. The arm 72 is pivoted as shown by the arrow in FIG. 8 to locate the spring 70 and arm 72 within the cap 18. Alternatively, the arm can be broken away from the cap and spring and discarded, and the spring can simply be inserted into the cap 18.

The trays 14 are preferably blister cards or the like that carry a plurality of separate items in separate blister compartments 74 so that the items can be removed one at a time from each card 14. The trays or blister cards 14 can be made of plastic, paperboard, paper, foil or the like. For example, the cards 14 can include a transparent layer 76 defining the compartments 74 and a rupturable paper and/or foil backing 78 laminated to layer 76 to seal the items in the compartments 74. As illustrated in FIG. 7, the package 10 of the present invention includes a pair of separate blister cards 14 positioned back-to-back within the container body 12 and a divider 80 extending therebetween defining a pair of separate cavities, 82 and 84, within the container body 12. Of course, the package 10 can be designed to house multiple dividers 80 for storing three or more separate blister cards 14.

Preferably, the divider 80 is formed separate from the container body 12 and can be secured therein between the opposed sections, 20 and 22, of the body 12. The divider 80 can be molded of plastic or be formed of metal or other sheet material and can include apertures or recesses 86 for engaging about posts 88 extending inwardly from the opposed sections, 20 and 22, of the body 12. See FIG. 7. In addition, preferably the divider 80 extends substantially the full distance from the closed end 34 to the open end 36 of the container body 12 and extends substantially parallel to the front and rear walls, 26 and 28, of the container body 12. See FIG. 6. When the package 10 is assembled, the divider 80 remains stationary within the container body 12 and provides the container body 12 with the opposite hollow cavities, 82 and 84, into which separate blister cards 14 can be housed and from which the cards 14 can be slid into dispensing positions.

Figure 5:
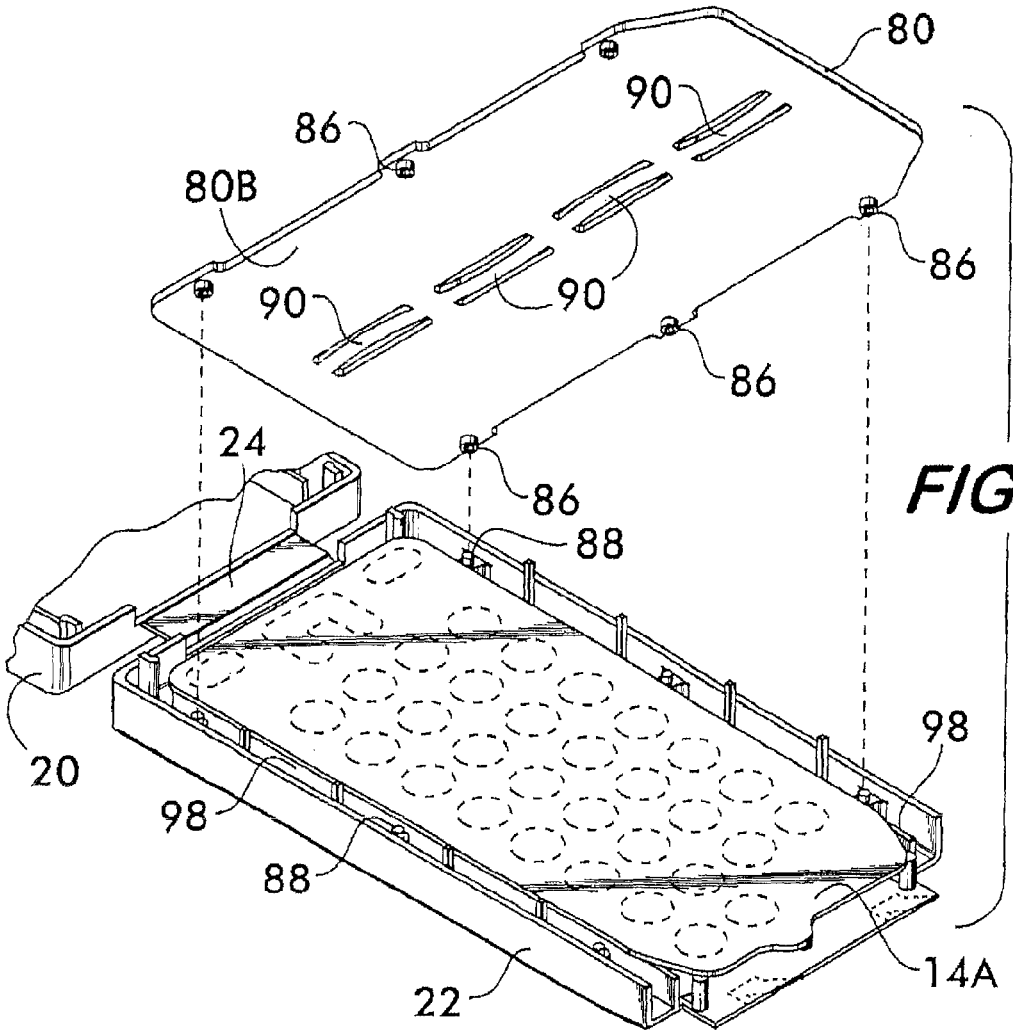
FIG. 5 is a perspective view of the container during assembly in which a divider is ready for placement therein.
Figure 6:
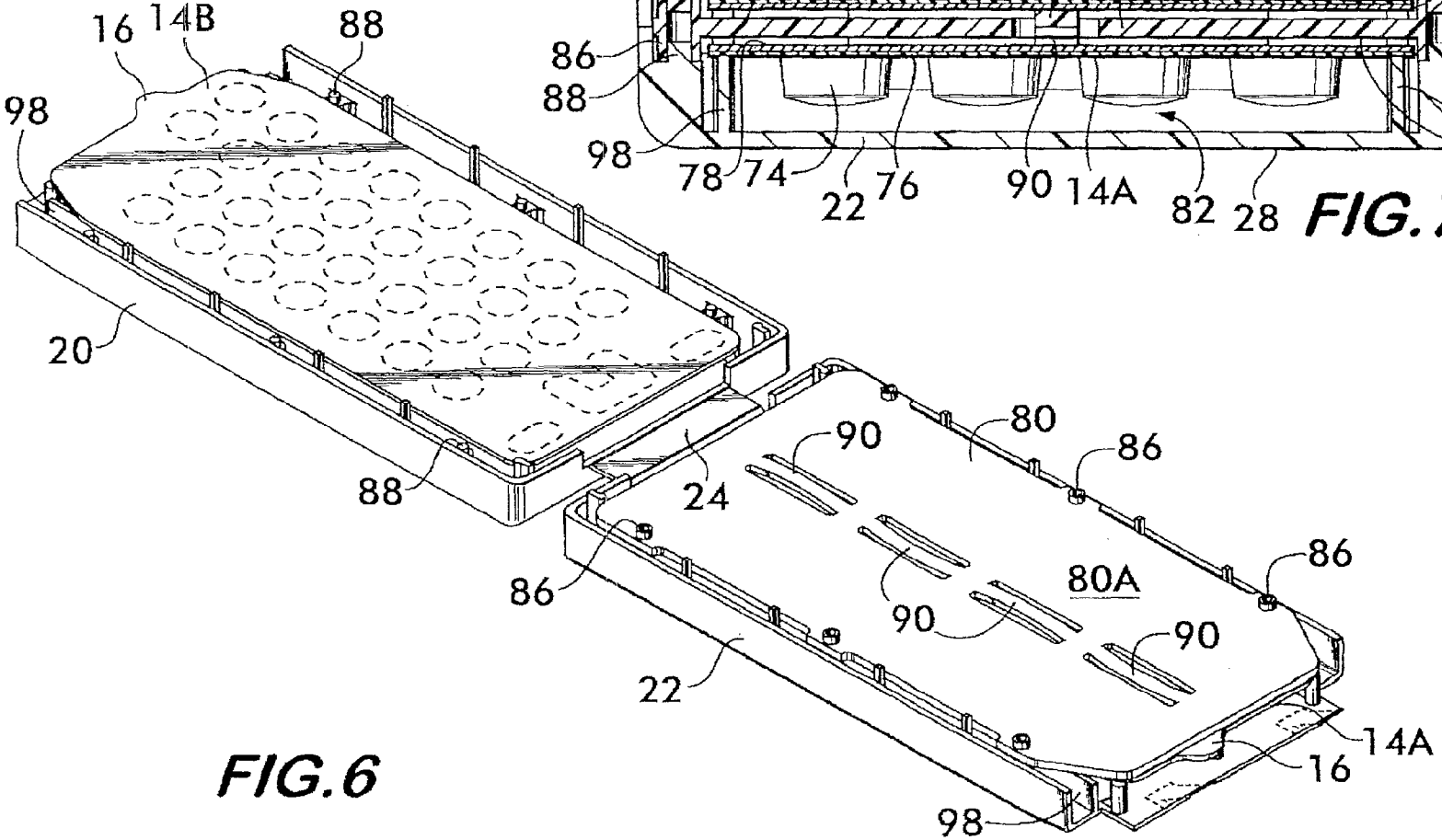
FIG. 6 is a perspective view showing placement of the divider and a separate second blister card within the container during assembly of the package.

As best illustrated in FIGS. 5-7, the divider 80 can have a plurality of integrally-formed, outwardly-bowed sections 90 which project outwardly from the opposite faces, 80A and 80B, of the divider 80 into the cavities, 82 and 84. The sections 90 confront the cards 14 and press them into engagement with flanges 100 extending from the body sections, 20 and 22, of the container body. For example, as best illustrated in FIG. 7, the centrally disposed sections 90 urge the cards 14A and 14B against the flanges 98 extending adjacent the outer edges of the blister cards, 14A and 14B. The outwardly bowed sections 90 are sufficiently flexible to compensate for any difference in thickness of blister cards capable of being housed within the container body 12 and provide shock-absorbing and friction-reducing functions. Accordingly, when the cards 14 are housed within the container body 12, the bowed sections 90 press against the walls of the blister cards 14 and prevent the cards from rattling or other undesired movement within the sealed package 10. In addition, the bowed sections 90 also function to provide spacing between the cards 14 and the faces, 80A and 80B, of the divider 80 and enable the cards 14 to be slid in a smooth manner into the dispensing position or back into a storage position within the container body 12.

A tray locking mechanism is used to prevent complete removal of the trays or cards 14 from the container body 12. For example, the trays 14 can be placed in storage positions in which each tray 14 is housed within the container body 12. The cap 18 can be applied to and/or removed from the container body 12 when both trays 14 are in the storage position. See FIG. 2. After the cap 18 is removed from the container body 12, each tray 14 is free to slide through the elongate opening 42 to a dispensing position. Preferably, one or more locking flanges 92 or the like project from each tray 14 at distal ends 94 of the trays 14 and are prevented from passing beyond the elongate opening 42 of the container body 12 by one or more posts 96 or the like extending from each body section, 20 and 22 within the mouth finish 38 of the container body 12. Accordingly, the distal ends 94 of the blister cards 14 are captured within the container body 12. Other alternative tray locking mechanisms can be utilized.

In use, the plastic, relatively-rigid, substantially-rectangular package 10 can be used to store two or more separate blister cards 14 carrying a predetermined amount of tablets, such as doses of prescribed or over-the-counter medicines, vitamins, supplements, or the like. Indicia, such as days, dates, or other information, can be displayed directly on the cards 14 to provide the end-user with reminders as to the rate at which the doses should be taken. Indicia and/or labels can also be applied to the front and back of the container body 12 and to the end wall 44 of the cap 18. Further, the cap 18 and container body 12 can include alignment markings that aid the user in properly aligning the cap 18 with the container body 12.

As discussed above, an end-user removes the cap 18 by pressing the cap 18 toward the container body 12 and simultaneously sliding the cap 18 in a lateral direction as can be indicated by arrows or like indicia on the cap 18. After the cap 18 is removed, the end-user can grip an exposed tab 16 or the like of one of the blister cards 14 adjacent the mouth finish 38 of the container body 12 and can slide the blister card 14 out of the container body 12. Alternatively, the blister cards 14 may be caused to slide out of the container body 12 via a quick hand flicking motion of the container body 12. When the distal end 94 of the blister card 14 reaches the elongate opening 42 of the container body 12, further movement of the blister card 14 is prevented. In this dispensing position, the card 14 extends from the mouth finish 38 of the container body 12 and the blister compartments 74 can be accessed. After one or more tablets have been removed from the blister cards 14, the blister cards 14 can be returned to within the container body 12 to a fully retracted storage position. Thereafter, the cap 18 can be reapplied and snapped into place on the container body 12. This process can be repeated until all blister compartments 74 are empty at which time the container body 12 and cap 18 can be reused, recycled, or discarded.

Figure 4:
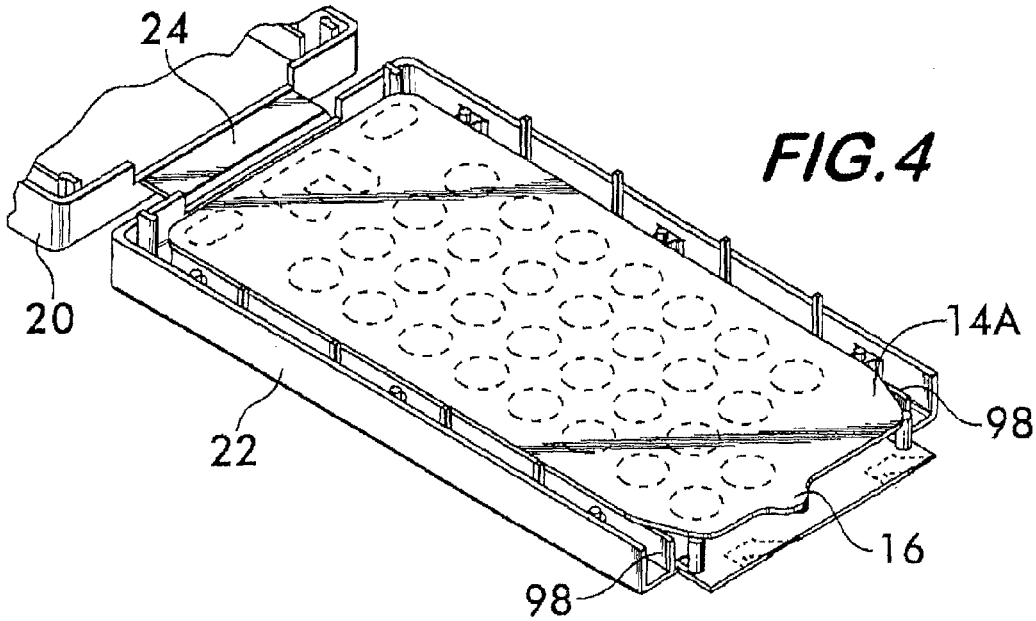
FIG. 4 is a perspective view showing the first blister card placed within the container during assembly of a package.

Another aspect of the present invention is the method of making and assembling a package for use in storing and dispensing tablets, such as medicine or the like. As best illustrated in FIG. 3, a plastic clam-shell type body is preferably injection molded such that opposite body sections, 20 and 22, are pivotally attached to one another and can be positioned open permitting ready loading of blister cards therein. Accordingly, as best illustrated in FIGS. 3, 4 and 6, separate first and second blister cards, 14A and 14B, are placed in face down orientation within the opposite open body sections, 20 and 22. A separate divider 80 is placed over one of the blister cards, 14A or 14B, and is snapped to one of the opposite body sections, 20 or 22.

After the above referenced loading steps, the opposite body sections, 20 and 22, are folded together into a closed position forming a container body 12. The divider 80 is centered within the container body and separates the first and second blister cards, 14A and 14B. See FIG. 7. Thereafter, the body sections, 20 and 22, are secured together such as being sonically welded together. A spring 70 is mounted within a cap 18 (see FIG. 8), and the cap 18 is applied to the container body 12 to form an assembled package 10 (see FIG. 1).

The above referenced steps are preferably accomplished utilizing automated, high-speed equipment enabling commercial-sized quantities of the packages to be formed, loaded with blister cards, and assembled in a cost efficient manner within a relatively short period of time. The packages of the present invention meet and surpass the standards required for a child proof package yet are easy to open and close by adults including senior citizens. Further, the packages are made of materials that can be readily recycled thereby providing a package that is both environmentally-friendly and inexpensive to manufacture.

While preferred unit dose packages and methods of assembly have been described in detail, various modifications, alterations, and changes may be made without departing from the spirit and scope of the unit dose package and assembly method according to the present invention as defined in the appended claims.

The invention claimed is:

1. A package for storing and dispensing tablets and like items, comprising:

a hollow plastic container body having opposed front and rear walls and an end with a mouth finish defining an opening, said front and rear walls having flanges extending within said container body;

a divider positioned within said container body extending between and substantially parallel to said opposed front and rear walls and defining separate cavities on either side thereof within said container body, said divider having opposite faces and including flexible, integrally-formed, outwardly-bowed sections that project outwardly from said faces into said cavities;

first and second separate trays each carrying a plurality of tablets or like items, said trays being positioned within opposite ones of said cavities on opposite sides of said divider, and each of said trays being slidable relative to said container body such that each of said trays is slidable between a retracted storage position in which said tray is located within said container body and a dispensing position in which at least a part of said tray extends through said opening of said container body, said outwardly-bowed sections of said divider pressing said trays into engagement with said flanges extending from said front and rear walls of said container body to prevent undesired movement of said trays within said container body and to enable said trays to slide in a smooth manner between said storage position and said dispensing position;

tray locking mechanisms for preventing distal ends of said trays from being released from said container body; and a separate plastic cap removably securable to said mouth finish of said container body to seal said opening and prevent access to said trays;

each of said trays being a blister card and including a plurality of separate blister compartments for securing the tablets or like items to said trays.

2. A package according to claim 1, wherein said cap has an elongate end wall and a skirt depending therefrom, wherein said skirt includes opposed front and rear flaps and opposed side flaps, and wherein said front and rear flaps overlap said mouth finish of said container body when said cap is applied to said container body and said side flaps of said skirt do not overlap said container body.

3. A package according to claim 2, wherein said opposed front and rear flaps of said skirt extend further from said end wall of said cap then said opposed side flaps of said skirt.

4. A package according to claim 3, wherein tips of said front and rear flaps of said skirt include beveled edges.

5. A package according to claim 4, wherein said mouth finish has an inward taper.

6. A package according to claim 1, wherein said cap has an end wall with a spring secured to an underside thereof.

7. A package according to claim 6, wherein said spring is made of plastic and is bowed along its length.

8. A package according to claim 6, wherein one of said container body and cap has a series of lugs and the other has a series of channels in which said lugs are captured when said cap is engaged to said container body.

9. A package according to claim 8, wherein each of said channels is formed in an outer surface of said mouth finish of said container body and has a reversely-turned section and an open section, whereby removing said cap from said container body requires said cap to be pressed toward said container body against the force of said spring and slid laterally so that said lugs are permitted to exit said reversely-turned sections and be released through said open sections.

10. A method of assembling said package for storing and dispensing tablets or like items according to claim 1, comprising the steps of:

positioning a one-piece plastic article in an open condition, said article including opposed body sections interconnected at ends thereof;

after said positioning step, placing said first blister card in one of said body sections, placing said second separate blister card in the other of said body sections, and placing said separate divider into one of said body sections over one of said first or second blister cards; and folding said one-piece article into a closed condition to form said hollow container body housing said first and section blister cards separated by said divider.

11. A method according to claim 10, further comprising the step of forming said one-piece article in an injection mold.

12. A method according to claim 10, further comprising the step of bonding, welding, or fastening said opposed body sections together after said folding step.

13. A method according to claim 12, wherein said bonding, welding, or fastening step includes sonic welding of said body sections.

14. A method according to claim 12, further comprising the step of applying said cap to said container body.

15. A method according to claim 14, further comprising the step of mounting a spring within said cap.

16. A method according to claim 15, further comprising the step of simultaneously forming said cap and said spring in an injection mold from a plastic material.

* * * * *